US007422350B2

(12) United States Patent
Haddad

(10) Patent No.: US 7,422,350 B2
(45) Date of Patent: Sep. 9, 2008

(54) PENDENT STYLE LUMINAIRE SPLIT DESIGN

(75) Inventor: Eric M. Haddad, East Berlin, PA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 0 days.

(21) Appl. No.: 11/735,651

(22) Filed: Apr. 16, 2007

(65) Prior Publication Data

US 2007/0291497 A1 Dec. 20, 2007

Related U.S. Application Data

(63) Continuation of application No. 11/425,019, filed on Jun. 19, 2006, now Pat. No. 7,210,827.

(51) Int. Cl.
*F21V 15/04* (2006.01)

(52) U.S. Cl. ..... 362/427; 362/374; 362/362

(58) Field of Classification Search ..... 362/374, 362/362

See application file for complete search history.

(56) References Cited

U.S. PATENT DOCUMENTS

| | | | |
|---|---|---|---|
| D51,774 | S | 2/1918 | Coppinger |
| 1,357,539 | A | 11/1920 | Bissell |
| 1,633,837 | A | 6/1927 | Youtz |
| 1,702,746 | A | 2/1929 | Prichard |
| 2,080,120 | A | 5/1937 | Everett |
| 2,166,394 | A | 7/1939 | Crossley |
| 2,758,199 | A | 8/1956 | Yonkers |
| 2,836,709 | A | 5/1958 | Dusen, Jr. |
| 2,960,361 | A | 11/1960 | Boutelle |
| 3,040,994 | A | 6/1962 | Anderson et al. |
| 3,096,029 | A | 7/1963 | Berge |
| 3,202,070 | A | 8/1965 | Pratt, Jr. et al. |
| 3,251,987 | A | 5/1966 | Wince |
| 3,299,265 | A | 1/1967 | Rackley et al. |
| 3,299,591 | A | 1/1967 | Woelk |
| 3,340,393 | A | 9/1967 | Frank et al. |
| 3,347,008 | A | 10/1967 | Strengholt |
| 3,388,246 | A | 6/1968 | Bailey |
| 3,413,462 | A | 11/1968 | Spero |
| 3,448,260 | A | 6/1969 | Wince et al. |
| 3,461,283 | A | 8/1969 | Hahn |
| 3,505,515 | A | 4/1970 | Adra |
| 3,529,148 | A | 9/1970 | Stefano et al. |
| 3,543,016 | A | 11/1970 | Jones |
| 3,604,916 | A | 9/1971 | Adra |
| 3,701,898 | A | 10/1972 | McNamara, Jr. |
| 3,711,702 | A | 1/1973 | Adra |

(Continued)

*Primary Examiner*—Anabel M Ton
(74) *Attorney, Agent, or Firm*—Chad D. Bruggeman; Middleton Reutlinger

(57) ABSTRACT

The pendent style luminaire split design incorporates generally a housing split into sections, a first section of the housing is attached to the top member located at the mounting arm while the second section of the housing is attached to the lens frame. The second section swings about a hinge between the first section and the lens frame. In the open position of the luminaire, the design allows for the convenience of "hands free" maintenance of both the lamp and the electrical component assembly of the luminaire at the same time. A sealed optical chamber is created, since neither the lens nor lens frame is needed to be separated from the reflector to gain access to the lamp.

20 Claims, 7 Drawing Sheets

U.S. PATENT DOCUMENTS 3,940,898 A 3/1976 Kaufman
3,990,201 A 11/1976 Falbel
3,991,905 A 11/1976 Nicpon
4,001,778 A 1/1977 Ross
4,015,394 A 4/1977 Kessler
4,027,151 A 5/1977 Barthel
4,029,630 A 6/1977 Meinhold et al.
4,090,210 A 5/1978 Wehling et al.
4,091,444 A * 5/1978 Mori ..... 362/374
4,141,061 A 2/1979 Ford et al.
4,143,412 A 3/1979 Sassmannshausen
4,143,413 A 3/1979 Kelly
4,155,111 A 5/1979 Kelly et al.
4,164,784 A 8/1979 Jaksich
4,173,037 A 10/1979 Henderson, Jr. et al.
4,212,050 A 7/1980 Trenkler
4,213,170 A 7/1980 Kimball et al.
4,218,727 A 8/1980 Shemitz et al.
4,229,782 A 10/1980 Ruud et al.
4,240,853 A 12/1980 Pustka
4,242,725 A 12/1980 Douma et al.
4,261,030 A 4/1981 Hernandez
4,293,901 A 10/1981 Hernandez
4,310,876 A 1/1982 Small, Jr. et al.
4,318,237 A 3/1982 Hicks
4,319,313 A 3/1982 Eberhart et al.
4,323,954 A 4/1982 Florence et al.
4,323,956 A 4/1982 Pustka
4,333,131 A 6/1982 Hujimoto et al.
4,364,108 A 12/1982 Rapp
4,395,750 A 7/1983 Scheidemann et al.
4,447,863 A 5/1984 Fenne
4,450,660 A 5/1984 Dean et al.
4,459,789 A 7/1984 Ford
4,462,068 A 7/1984 Shadwick
4,473,873 A 9/1984 Quiogue
4,480,809 A 11/1984 Healey
4,527,224 A 7/1985 Sangiamo et al.
4,531,180 A 7/1985 Hernandez
4,546,420 A 10/1985 Wheeler et al.
4,587,602 A 5/1986 Dean et al.
4,590,544 A 5/1986 Decandia
4,602,320 A 7/1986 Tomkin et al.
4,623,956 A 11/1986 Conti
4,626,975 A 12/1986 Miletich
4,717,991 A 1/1988 Murphree, Jr.
4,760,511 A 7/1988 Russello et al.
4,766,709 A 8/1988 Galbraith
4,786,344 A 11/1988 Beuther
4,816,969 A 3/1989 Miller
4,893,224 A 1/1990 Tinley
5,016,150 A 5/1991 Gordin et al.
5,062,029 A 10/1991 Engel
5,068,769 A 11/1991 Umeda et al.
5,081,569 A * 1/1992 Quiogue et al. ..... 362/328
5,099,405 A 3/1992 Gehly et al.
5,111,371 A 5/1992 Nielson
5,140,507 A 8/1992 Harwood
5,183,331 A 2/1993 Edgell et al.
5,278,737 A 1/1994 Luce et al.
5,289,358 A 2/1994 Halemeier
D348,745 S 7/1994 Ewing et al.
5,339,234 A 8/1994 Russello et al.
5,377,087 A 12/1994 Yoon
5,404,297 A 4/1995 Birk et al.
5,435,087 A 7/1995 Karkar et al.
5,446,637 A 8/1995 Cunningham et al.
5,450,303 A 9/1995 Markiewicz et al.
D370,228 S 5/1996 Chapman et al.
5,572,819 A 11/1996 Topinka et al.
5,613,766 A 3/1997 Raouf
5,642,934 A 7/1997 Haddad
5,647,659 A 7/1997 Mori
5,704,710 A * 1/1998 Greene et al. ..... 362/374
D390,994 S 2/1998 Ewing et al.
D390,995 S 2/1998 Ewing et al.
D391,383 S 2/1998 Ewing et al.
5,722,770 A 3/1998 Douglas
5,743,632 A 4/1998 Carl
5,803,585 A 9/1998 Littman et al.
D400,277 S 10/1998 Ewing et al.
5,826,975 A 10/1998 Hsieh et al.
5,906,431 A 5/1999 Chianale et al.
6,017,131 A 1/2000 Goins
D424,736 S 5/2000 Johnson
6,290,376 B1 9/2001 Gutierrez et al.
6,402,352 B1 6/2002 Summerford et al.
6,450,657 B1 9/2002 Testa et al.
D469,565 S 1/2003 Anderson et al.
6,840,658 B2 1/2005 Anderson et al.
RE38,767 E * 8/2005 Wedell et al. ..... 362/652
7,059,747 B2 6/2006 Barozzini et al.
7,121,684 B2 10/2006 Barozzini et al.
7,210,827 B1 * 5/2007 Haddad ..... 362/375
2002/0018344 A1 2/2002 Sears, Jr. et al.
2005/0117333 A1 6/2005 Yoshida et al.

* cited by examiner

PENDENT STYLE LUMINAIRE SPLIT DESIGN

CROSS-REFERENCE TO PRIOR APPLICATION

This is a continuation of U.S. patent application Ser. No. 11/425,019 filed on Jun. 19, 2006.

TECHNICAL FIELD

The present invention relates to luminaires and particularly to a pendent style luminaire split design.

DETAILED DESCRIPTION

Figure 1:
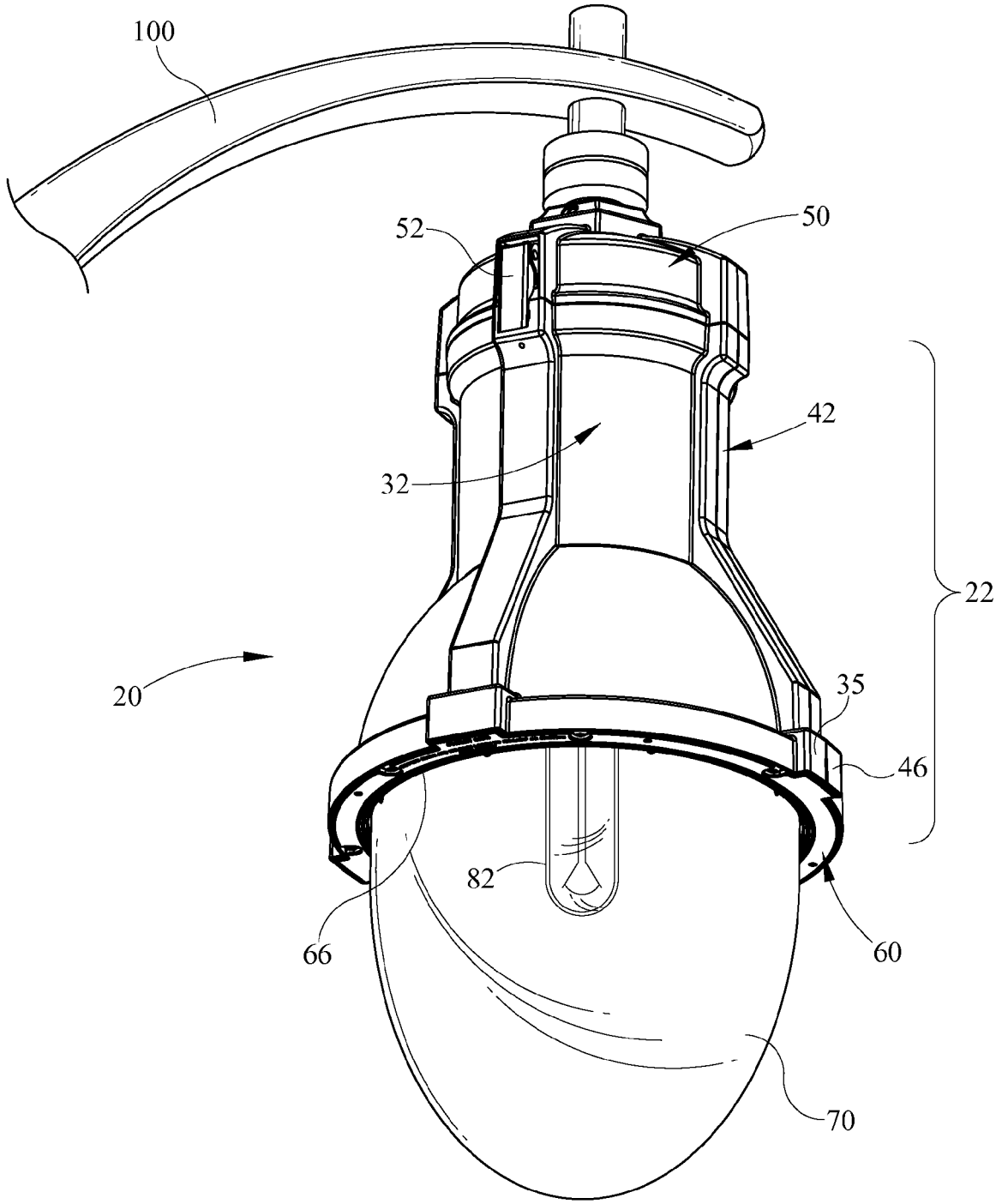
FIG. 1 is a bottom perspective view of a pendent style luminaire having a split design in a closed configuration depending from a mounting arm.

The pendent style luminaire 20 of the present invention depicted in the drawings functions to create convenience for "hands free" maintenance of both lamps and electrical component assemblies or other internal components at the same time. The luminaire 20 design also provides dust and water tight seals to prolong the life and minimize maintenance of the lamp and luminaire.

Figure 2:
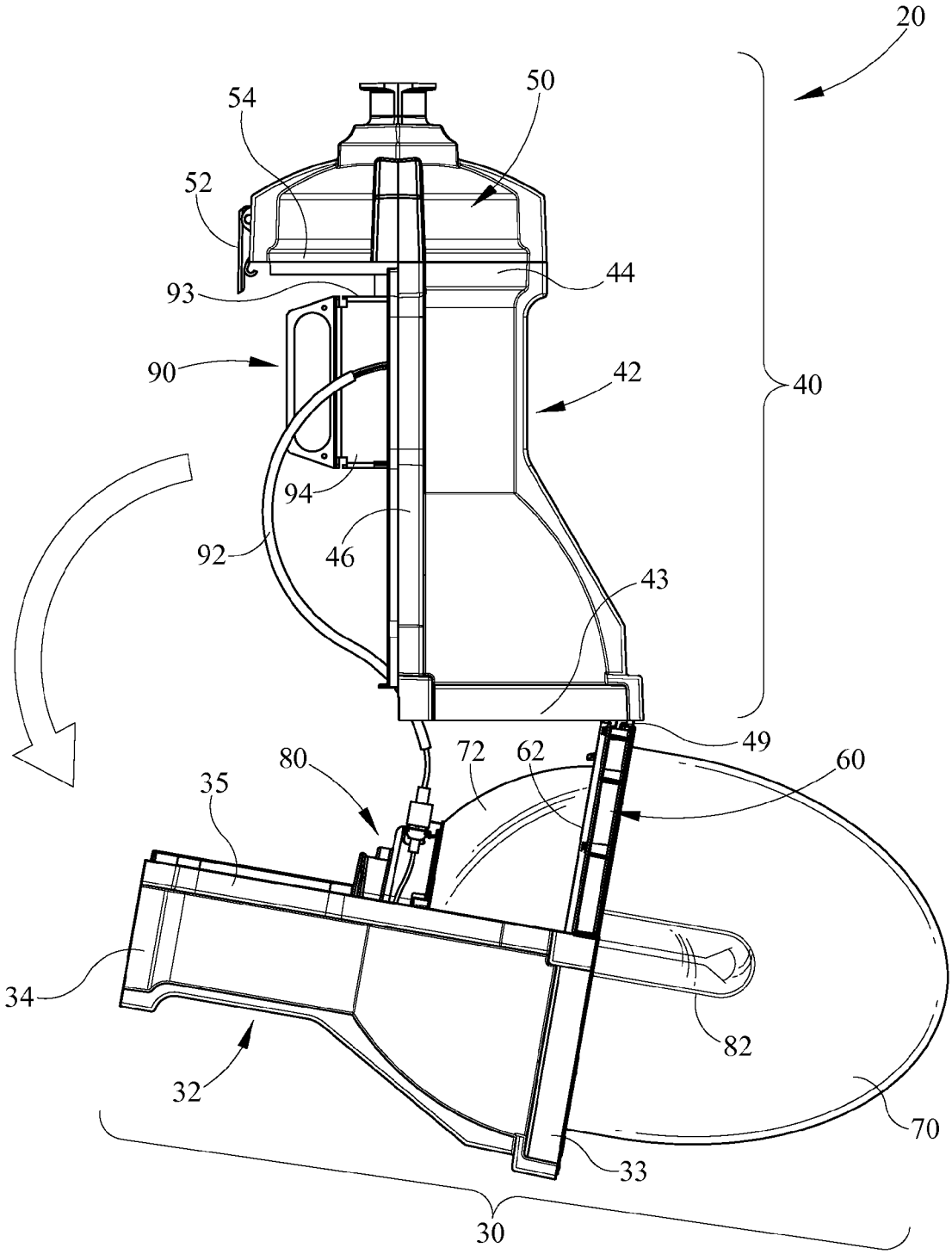
FIG. 2 is a side view of the pendent style luminaire design of FIG. 1 in an open configuration.

With reference to FIGS. 1 and 2, a pendent style luminaire 20 may include a top casting 50, a housing 22, a lens frame 60, a reflector 72, and a lens 70. Housing 22 may be further divided into a first housing 42 and a second housing 32. Luminaire 20 is capable of being opened for access by a user whereby a hinged bottom 30, comprising a second housing 32, lens frame 60, a reflector 72, and lens 70, is hingedly attached to first housing 42 of hinged top 40. Luminaire 20 may be rotated by means of hinge 49 from a closed configuration, as shown in FIG. 1, to an open configuration, as shown in FIG. 2.

As shown in FIGS. 1, 2, 3, and 4, housing 22 comprises a flared first housing 42 and a similarly flared second housing 32 mutually opposed and substantially parallel. A top member or casting 50 is disposed orthogonally to the first housing and second housing, and lens frame 60 is disposed orthogonally to the lower portion of the first housing and second housing. Lens 70 is disposed over an open aperture 66 formed by lens frame 60. Housing 22, top casting 50, and lens frame 60 may be made from, but not limited to, cast aluminum or other materials known in the art for example metal or plastic. Housing 22 is essentially split along a substantially vertical axis separating first housing 42 and second housing 32 from each other. Although the housing 22 is shown in great detail with a substantially vertical split, it should be understood that there are many variations of the shape of the line of demarcation between hinged top 40 and hinged bottom 30 that can be used within the scope of the invention.

Figure 3:
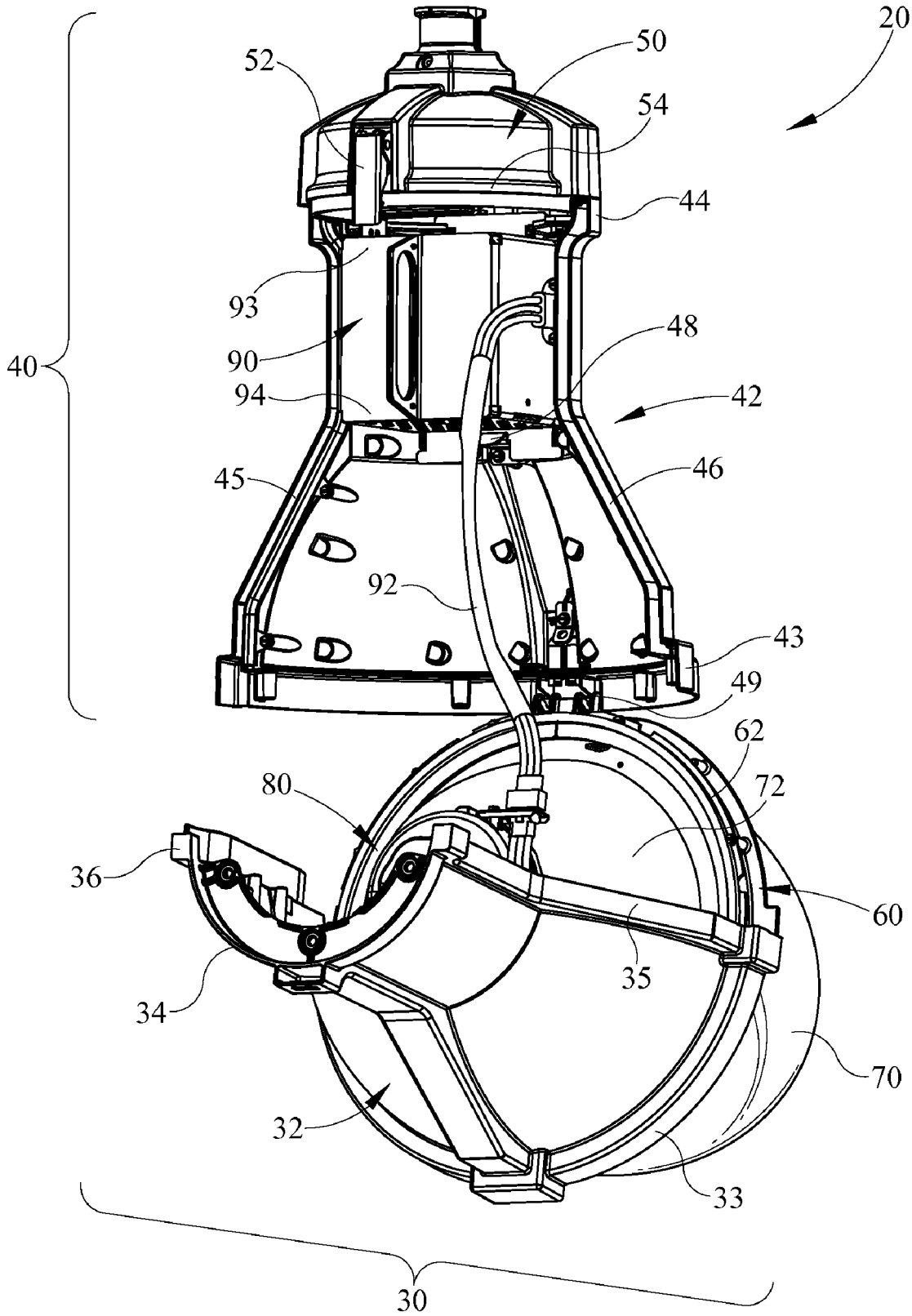
FIG. 3 is a bottom perspective view of the pendent style luminaire design of FIG. 2 in an open configuration.
Figure 4:
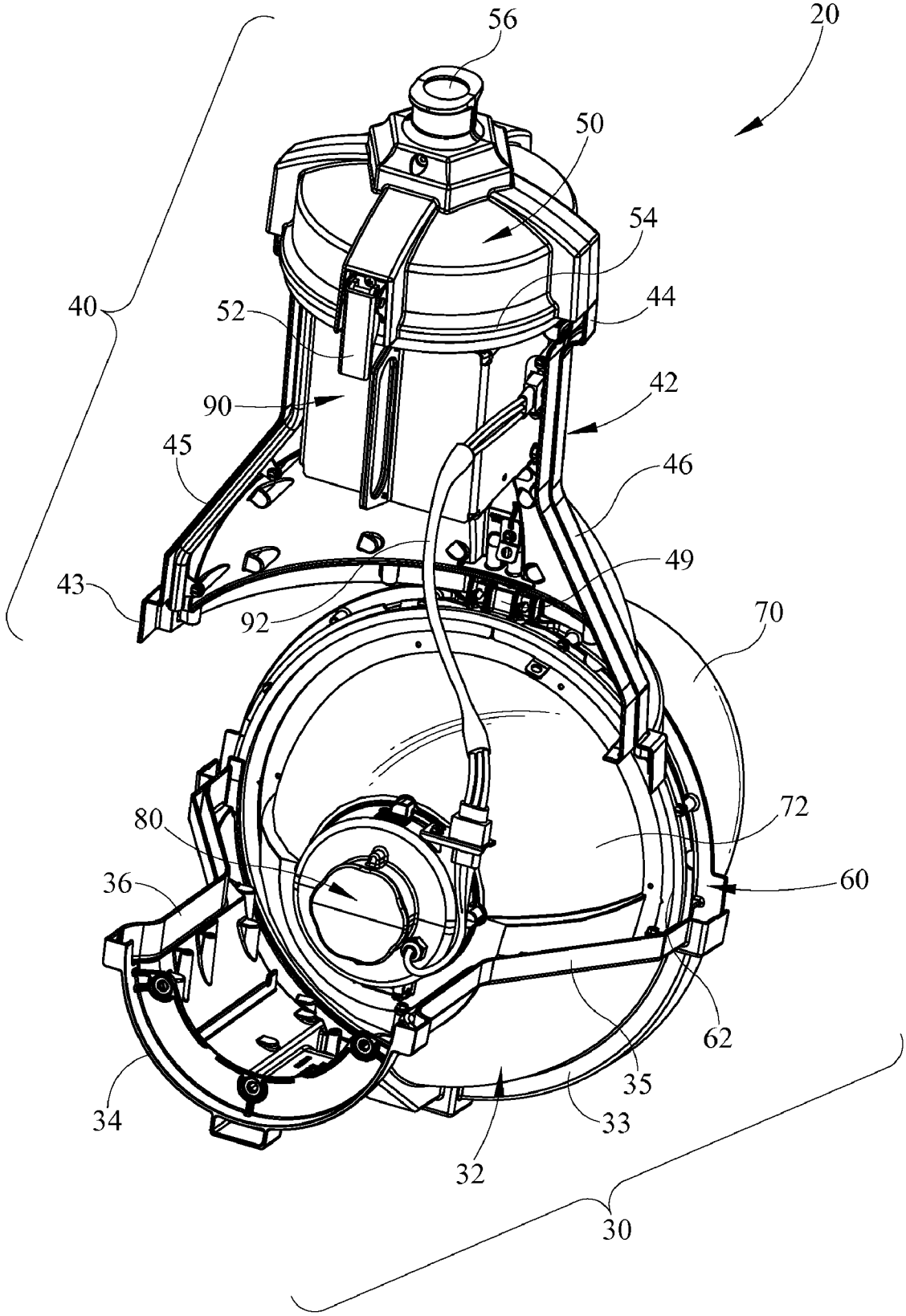
FIG. 4 is a top perspective view of the pendent style luminaire design of FIG. 2 in an open configuration.

Lens frame 60 as shown in FIGS. 2, 3, and 4 is hingedly attached to first housing 42 to allow for luminaire 20 to rotate from a closed configuration (FIG. 1) to an open configuration (FIG. 2). Lens frame 60 is substantially ring-shape, and essentially half the circumference of lens frame 60 is secured to a bottom end 33 of second housing 32. The remaining half of the circumference of lens frame 60 may be releasably secured to a bottom end 43 of first housing 42. A hinge 49, hingedly connecting lens frame 60 to bottom end 43 of first housing 42, is located in a substantially opposed position from the area where second housing 32 is secured to lens frame 60. Because hinge 49 is placed in a substantially opposed position, the weight of second housing 32 maximizes the cantilever action that occurs when the luminaire naturally travels to its open configuration (FIG. 2) by gravity. The cantilever action pivots about hinge 49 which may allow lens 70, lens frame 60, reflector 72, and second housing 32 (hinged bottom 30) to travel to its open configuration and remain in the open configuration without requiring the user to tie up his or her hands to keep luminaire 20 open for access by the user. The natural cantilever action of hinged bottom 30 provided by gravity, allows for internal component access without requiring the luminaire to be kept open by hand.

Hinge 49, illustrated in FIGS. 2, 3, and 4, is merely representative of hinges in general, and it should be understood that there are many locations and variations of hinges that may be used with hinged top 40 and hinged bottom 30 sections. For example, a hinge may be placed externally to housing 22 (not shown) and still function to swing hinged bottom 30 into an open configuration.

As shown in FIGS. 1-4, top casting 50 is generally dome-shaped with housing 22 depending therefrom. As shown in FIG. 1, top casting 50 may be secured to a mounting arm 100, or other mounting device known in the art, which in tummay extend from a pole assembly (not shown). Top end 44 of first housing 42 is affixed to generally half of a lower end 54 of the top casting, while the remaining portion of lower end 54 of the top casting is releasably affixed to a top end 34 of second housing 32. In the closed configuration (FIG. 1), top casting 50 may have a manually operated latch 52 which engages second housing 32 to enable the second housing to be releasably secured. However, there are a variety of mechanisms known in the art, with manually or tool operated, which can be used to secure luminaire 20 in the closed configuration and still be within the scope of the invention. First housing 42 also has two opposed edges 45 and 46 which engage respectively with second housing's two opposed edges 35 and 36. The mating of the respective edges along the line of demarcation between the hinged bottom 30 and hinged top 40 may include gaskets, o-rings, seals or the like to provide sealing along the line of demarcation, resulting in longer life of the lamp and minimizing maintenance of internal components such as a electrical component assembly 90. Also, the mating of hinged bottom 30 and hinged top 40 along the line of demarcation may incorporate tongue and groove mating to maximize the sealing engagement when closing the luminaire into the closed configuration.

Figure 5:
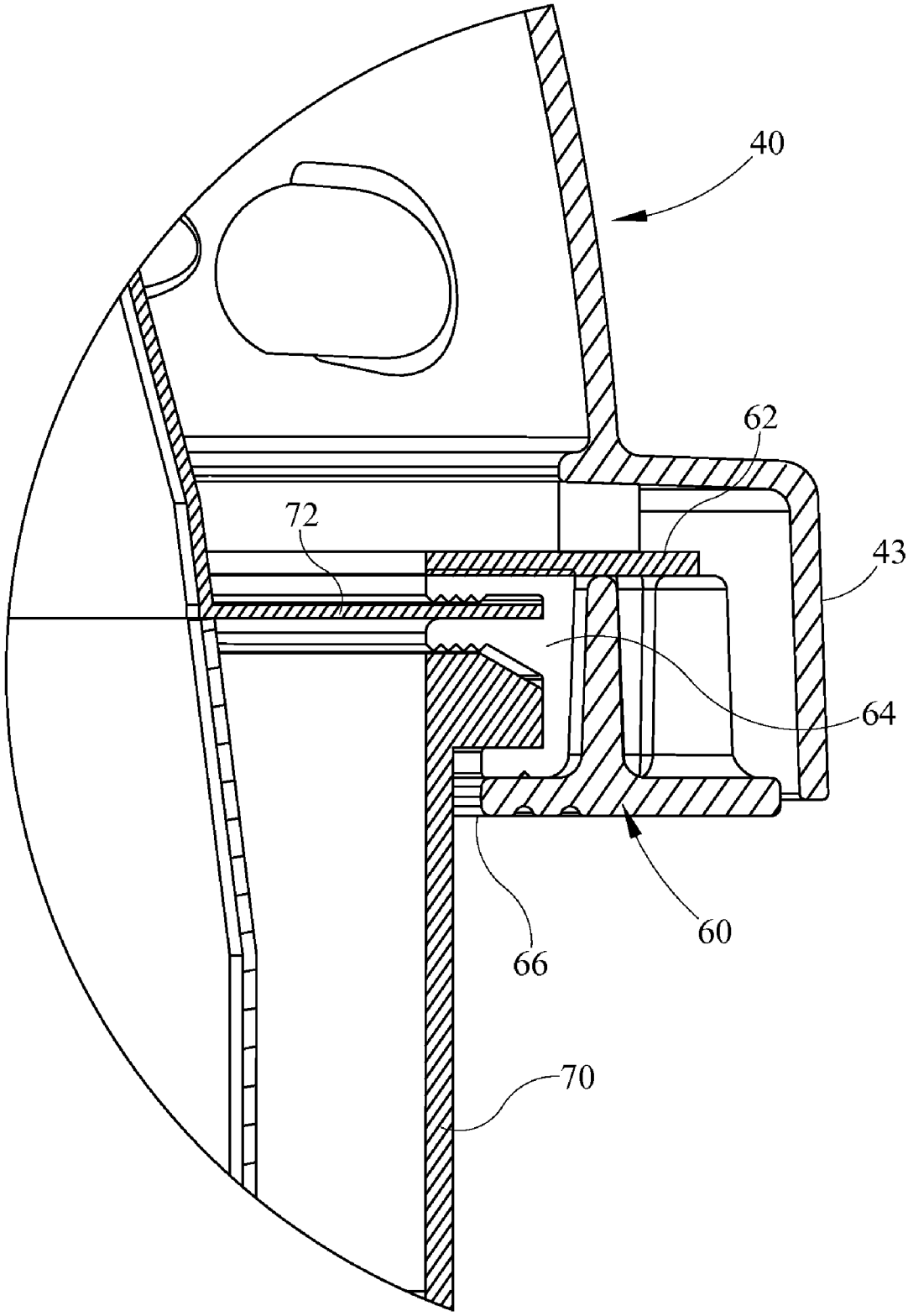
FIG. 5 is an enlarged, partial sectional view of the lens frame junction with the lens and reflector of the luminaire of FIG. 1.

As shown in FIGS. 1-5, lens 70 or globe depends from or seats within lens frame 60. Lens 70 may be substantially, but is not limited to, acorn shaped. The globe or lens 70 is typically made from glass or plastic. The ring-shaped lens frame 60 allows for lens 70 to pass through open aperture 66 of the lens frame and rest within the interior surface of the lens frame. Located adjacent to lens 70 is reflector 72 of luminaire 20. Reflector 72 extends from the junction between lens 70 and lens frame 60 in the opposite direction from lens 70. Reflector 72 has an open aperture 73 (FIG. 6) being dimensioned to receive a lamp module 80 and to focus light generated from a lamp 82 towards lens 70. A seal 64 creates a sealing mechanism at the junction between reflector 72, lens 70, and lens frame 60. Seal 64 with its engagement with lens 70 and reflector 72 may be held in place by a lens frame clamp 62 as shown in FIG. 5. Although seal 64 is shown in detail, the junction between the lens frame, lens, and reflector may include a gasket, o-ring, or any seal or combination thereof known in the art to create the required sealing effect. Seal 64, enclosing the optical chamber of the lens, lens frame, and reflector, is essentially permanent because the seal 64 remains unbroken since neither lens, lens frame, nor reflector need to be separated to gain access to lamp module 80 for repair, replacement, or maintenance. This essentially sealed optical chamber creates a water and dust proof enclosure which prolongs the life and minimizes the maintenance required of the lamp and luminaire.

During maintenance, lamp module 80 is accessible by the user when luminaire 20 is positioned in the open configuration (FIG. 2). Open aperture 73 of reflector 72 may have a dual radial-sealed, removable socket casting 74 allowing for the tool free removal of lamp module 80 for re-lamping. Lamp module 80 has at its base 84 an inner circumferential surface which may seal to a single or dual radial-sealed socket casting 74. The dual seal may be created by an upper o-ring 75 and a lower o-ring 76. Dual radial-sealed socket casting 74 is affixed to or part of aperture 73 of reflector 72. Lamp module 80 may also have an internal thread to cooperate with external threads on the dual radial sealed socket casting. Lamp module 80 may be installed by axially inserting the module into reflector 72 and turning to lock and seal the top of the optical chamber. With lamp module 80 capable of being removed without the aid of tools, the lamp module is conveniently replaced. Although the seal engagement between lamp module 80 and socket casting 74 is shown in detail, a variety of seals or gaskets about the lamp module could be used to create and maintain the water and dust proof enclosure of the optical chamber.

Figure 6:
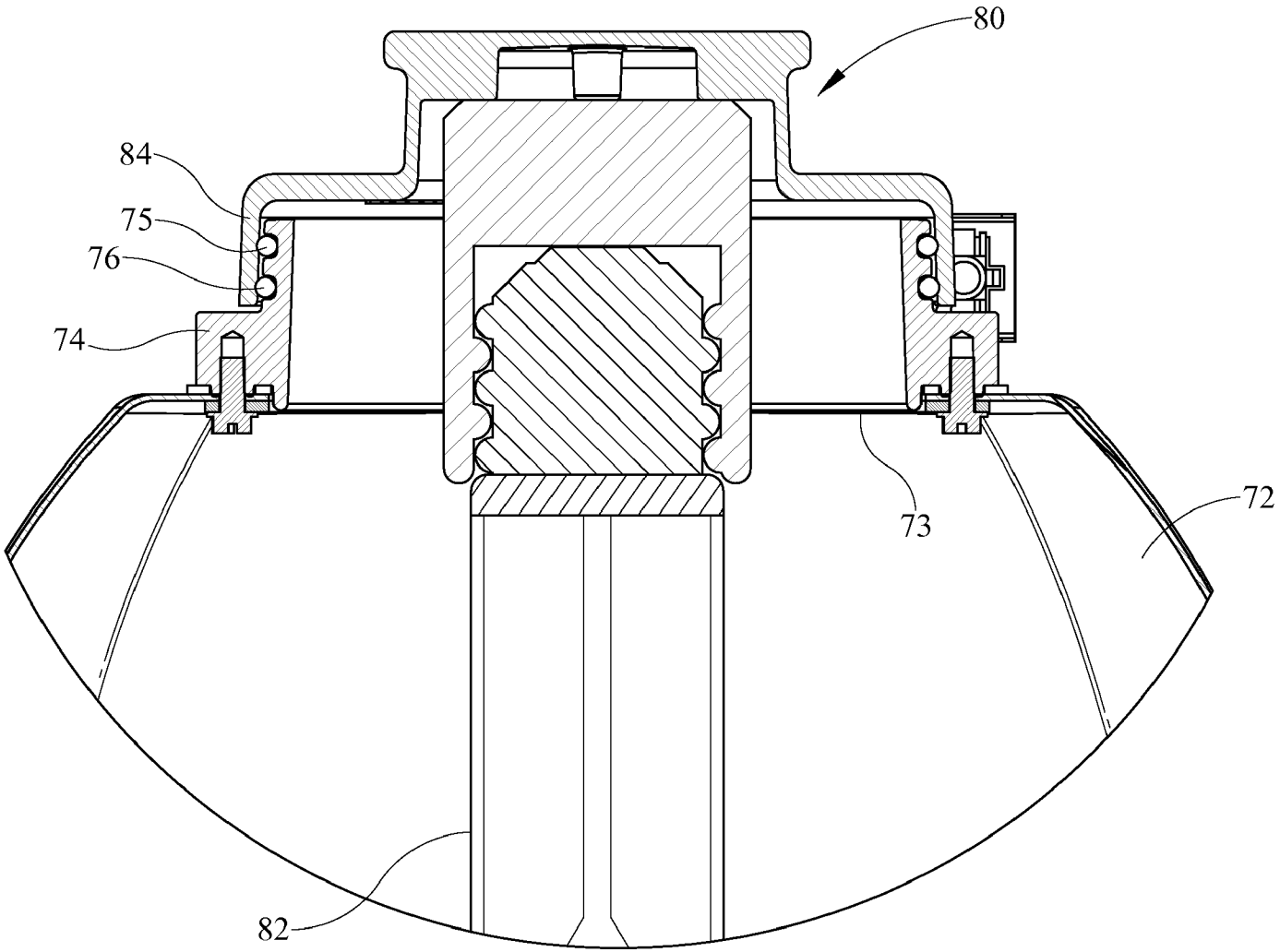
FIG. 6 is an enlarged, partial sectional view of a lamp module and a reflector of the luminaire of FIG. 2.
Figure 7:
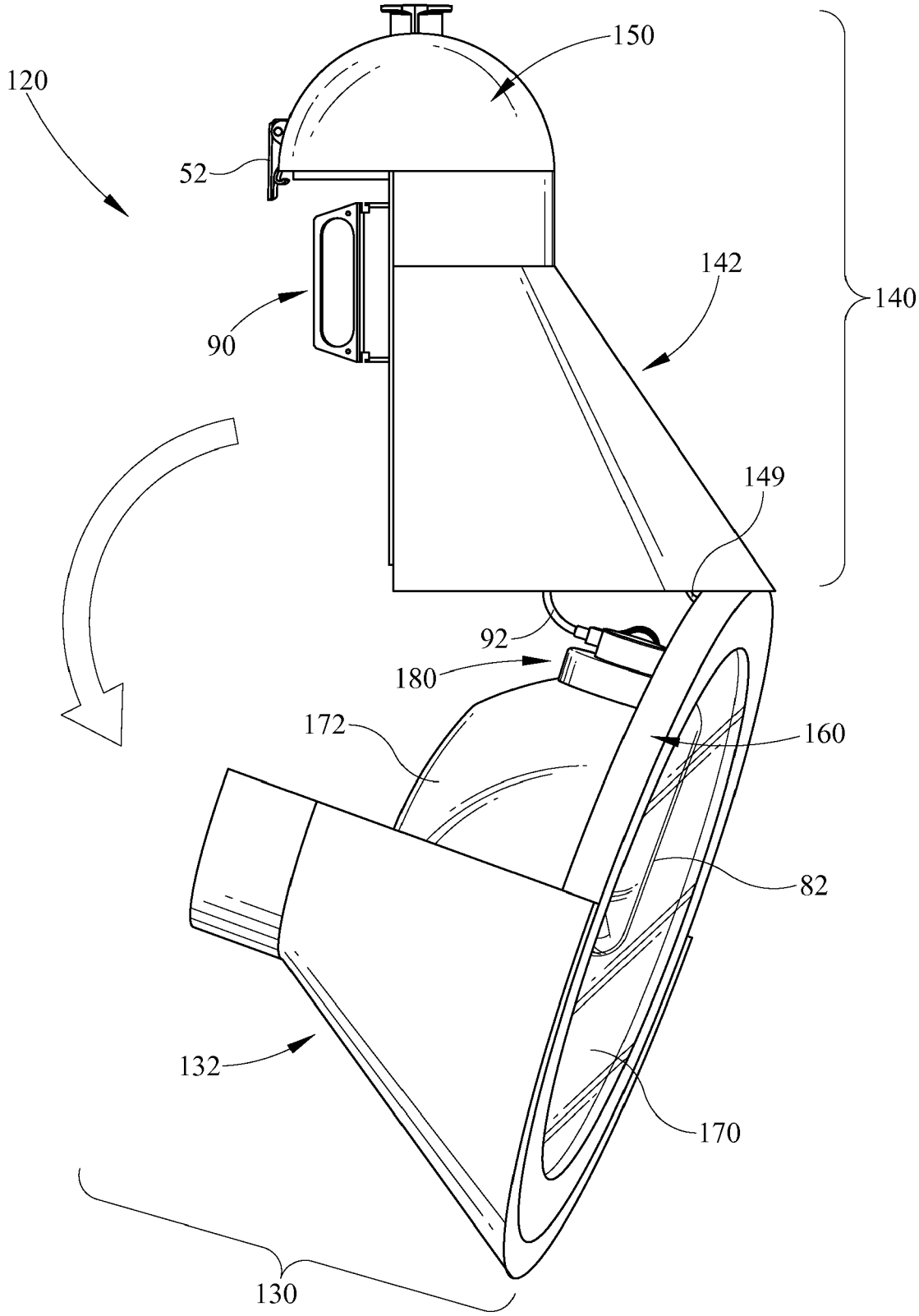
FIG. 7 is a side view of another embodiment of the pendent style luminaire design.

Although lens 70, lens frame, 60, and reflector 72 are shown in detail in FIGS. 2, 5, and 6, they are merely representative of lens, lens frames, and reflectors in general, and it is to be understood that there are many variations of those components that may be used with the luminaire. For example as shown in FIG. 7, a lens 170 affixed in luminaire 120 is substantially flat in shape while a reflector 172 has a low profile extending in a direction away from lens 170. Luminaire 120 has a hinged bottom 130 hingedly connected to a hinged top 142 by hinge 149. Also, as shown in FIG. 7, a lamp module 180 may extend horizontally from a lateral aperture in the reflector.

In use, pendent style luminaire 20 is operably connected to a power source (not shown). As shown in FIGS. 2, 3, and 4, lamp module 80 may be operably connected by a wire connection 92 to an electronic component assembly 90 located on the interior surface of first housing 42. Electronic component assembly 90 may then be wired through an open orifice 56 in top casting 50 and through mounting arm 100 (FIG. 1), or any other appropriate mount, to an external power supply (not shown). Electronic component assembly 90 may be mounted directly onto the interior of first housing 42 or may be attached to a removable tray inside the housing. Electronic component assembly 90 may include of a ballast, a capacitor, and an ignitor. As shown in FIG. 3, the removable electronic component assembly 90 may be mounted within first housing 42 at the bottom end 94 of the assembly which is secured by a clip 48 affixed to the interior surface of first housing 42. Clip 48 releases assembly 90 from engagement with the inner surface of first housing 42 for removal. Clip 48 may be manually operable without tools for quick removal. Electronic component assembly 90 may alternatively be attached inside the housing 22 in any number of locations by a variety of attachments known in the art including but not limited to screws or other manual or tool operated means. The convenience of manual removal without tools and the accessibility of the electronic component assembly optimizes the efficiency and ease of repair and maintenance by the user.

The luminaire 20 design allows for the user to conveniently have their hands free for maintenance of both lamp module 80 and electrical component assembly 90 at the same time. Luminaire 20 may be opened from the closed configuration (FIG. 1) to the open configuration (FIG. 2) by a manual latch 52 joining top casting 50 to second housing 32. Releasing latch 52 allows for hinged bottom 30 to pivot about hinge 49 in order for luminaire 20 to travel or cantilever to its open configuration. In traveling to the open configuration (FIG. 2), the weight of lens 70, lens frame 60, and second housing 32 results in a cantilever effect which minimizes the force needed by the user to open the luminaire. The weight of hinged bottom 30 also allows for the luminaire to hang and remain in its open configuration. Luminaire 20 remains in its open configuration without the aid of the user, thus the user needing to conduct maintenance on lamp module 80 and electrical component assembly 90 without needing to use their hands to keep the luminaire open and accessible. This frees the user's hands for maintenance, both for re-lamping purposes and accessing the electrical component assembly 90 at the same time thereby allowing ready service to all the internal components that typically require maintenance.

There are many useful variations in size and shape of pendent style luminaire 20 that can be manufactured using this design. Although the housing 22, lens frame 60, top casting 50, lens 70, and reflector 72 are shown in one configuration in FIG. 1, that is merely one representation of various design configurations that can be used to allow "hands free" access to both the lamp and electrical component assembly while also retaining a substantially permanent seal 64 of the optical chamber. A plurality of aesthetic designs for the outer enclosure of the luminaire 20 can be created and still be within the scope of the present invention.

It is understood that while certain embodiments of the invention have been illustrated and described, it is not limited thereto except insofar as such limitations are included in the following claims and allowable functional equivalents thereof.

I claim:

1. A pendent style luminaire comprising:

a housing having an upper end and a lower end, and a lens disposed over said lower end, said housing separable into a first member and a second member along a line extending away from an upper edge of said lens to said upper end;

wherein a hinged connection permits pivoting movement of said first member relative to said second member between an open configuration and a closed configuration.

2. The pendent style luminaire as in claim 1 further comprising an annular lens frame extending partially outward from said first member and supporting a reflector and said lens.

3. The pendent style luminaire as in claim 2 wherein said hinged connection is positioned between said annular lens frame and said second member.

4. The pendent style luminaire as in claim 2 wherein said hinged connection is affixed to said lens frame in a substantially opposing position to said first member.

5. The pendent style luminaire as in claim 2 wherein said reflector has an aperture being dimension to receive a lamp module.

6. The pendent style luminaire as in claim 1 further comprising a lamp module and an electrical component assembly accessible within said housing when in said open configuration.

7. The pendent style luminaire as in claim 1 wherein said first member is releasably affixed to said second member by a manual latch.

8. A pendent style luminaire comprising:

a split housing having a first portion and a second portion hingedly connected and separated by a line of demarcation, wherein said line of demarcation extends from adjacent a lower end of said housing receiving a lens to an upper end of said housing offset from said lens; and said second portion of said housing supporting said lens and a reflector when said split housing is in an open configuration.

9. The pendent style luminaire as in claim 8 wherein said second portion comprises a sealed optical chamber when said split housing is in said open configuration.

10. The pendent style luminaire as in claim 8 further comprising an electrical component assembly affixed to an interior surface of said first portion.

11. The pendent style luminaire as in claim 8 wherein said line of demarcation is substantially vertical above said lens.

12. The pendent style luminaire as in claim 8 wherein said line of demarcation is substantially S-shaped in cross section.

13. The pendent style luminaire as in claim 8 wherein said second portion comprises a lens frame having a top end and a bottom end, said lens disposed over an opening of said bottom end of said lens frame and said reflector extending from said top end of said lens frame.

14. The pendent style luminaire as in claim 8 further comprising a manual latch releasably affixing said second portion to said first portion to allow said split housing to be rotated between said open configuration and a closed configuration.

15. The pendent style luminaire as in claim 14 further comprising a lamp module and an electrical component assembly within said housing accessible in said open configuration.

16. The pendent style luminaire as in claim 8 wherein a hinged connection is positioned adjacent said lower end of said first portion.

17. A pendent style luminaire split design comprising:

a housing having a first member and a second member positioned in a closed configuration above a lens frame, said lens frame receiving a lens;

said first member affixed to said lens frame; and a hinge splitting said housing into an open configuration, wherein said first member releases from said second member.

18. The pendent style luminaire as in claim 17 wherein said hinge includes a substantially vertical line above said lens allowing said housing to be rotated between said open configuration and said closed configuration.

19. A pendent style luminaire split design comprising:

a housing wall having an upper end and a lower end, said lower end defining an opening, and a lens and a reflector sealingly received in said opening;

said housing wall separable from a closed configuration into a first member and a second member, wherein said first member supporting said lens and said reflector separates from said second member into an open configuration along a separating line extending from adjacent said upper end of said housing wall to adjacent said lower end of said housing wall; and a sealing engagement along said separating line between said first member and said second member when said housing wall is in said closed configuration.

20. The pendent style luminaire split design as in claim 19 further comprising a sealed optical chamber when said housing wall is in said open configuration.

* * * * *